US006926664B2

(12) United States Patent
Koch

(10) Patent No.: US 6,926,664 B2
(45) Date of Patent: Aug. 9, 2005

(54) HOODLESS INCUBATOR

(75) Inventor: Jochim Koch, Ratzeburg (DE)

(73) Assignee: Dräger Medical AG & CO. KGaA, Lübeck (DE)

( * ) Notice: Subject to any disclaimer, the term of this patent is extended or adjusted under 35 U.S.C. 154(b) by 0 days.

(21) Appl. No.: 10/780,956

(22) Filed: Feb. 18, 2004

(65) Prior Publication Data

US 2004/0242955 A1 Dec. 2, 2004

(30) Foreign Application Priority Data

Mar. 26, 2003 (DE) ..... 103 13 531

(51) Int. Cl.[7] ..... A61G 11/00
(52) U.S. Cl. ..... 600/22
(58) Field of Search ..... 600/21, 22; 128/205.26

(56) References Cited

U.S. PATENT DOCUMENTS 3,380,369 A * 4/1968 Allander ..... 454/189
3,511,162 A * 5/1970 Truhan ..... 454/187
3,625,133 A * 12/1971 Hayashi ..... 454/189
3,626,837 A * 12/1971 Pelosi et al. ..... 454/187
3,726,204 A 4/1973 Lindeströ m
3,803,995 A * 4/1974 Allander ..... 454/189
4,009,647 A * 3/1977 Howorth ..... 454/187
5,817,002 A 10/1998 Donnelly et al.
5,840,010 A * 11/1998 Kobayashi et al. ..... 600/22
5,897,485 A 4/1999 Koch
6,213,935 B1 4/2001 Mackin et al.
6,296,606 B1 * 10/2001 Goldberg et al. ..... 600/22
6,746,394 B2 6/2004 Donnelly
2002/0143233 A1 10/2002 Donnelly

FOREIGN PATENT DOCUMENTS

DE 197 25 498 C1 10/1998
EP 0 291 280 A1 11/1988

* cited by examiner

*Primary Examiner*—Samuel G. Gilbert
(74) *Attorney, Agent, or Firm*—McGlew and Tuttle, P.C.

(57) ABSTRACT

A hoodless incubator is provided, which supplies both a good microclimate in the area of the patient surface (1) and guarantees good access to the patient at the same time and continuously. The incubator includes a bed (1) and an air jet unit (6) arranged above the bed (1) and directed toward the bed (1). The air jet unit (6) discharges a jacketed impinging jet, formed of an inner, air-conditioned core jet (4) and a non-air-conditioned jacket jet (5) surrounding the core jet (4). The bed (1) is surrounded by a channel-like edge area (9), which is in flow connection with the air jet unit (6) via a first feed channel (13) with a first fan (11) arranged therein and with a heating and humidifying device (12) likewise arranged therein in order to form the air-conditioned core jet (4).

22 Claims, 6 Drawing Sheets

HOODLESS INCUBATOR

FIELD OF THE INVENTION

The present invention pertains generally to incubators such as infant incubators used for premature and newborn patients to provide a suitable microclimate in the interior space and more particularly the invention relates to a hoodless incubator.

BACKGROUND OF THE INVENTION

The incubators known so far for premature and newborn patients provide a suitable microclimate in the interior space, which is closed off by a bed and a generally transparent hood belonging to it. The heat losses of the immature patient can thus be compensated and the patient in question can be treated under thermally neutral conditions. However, these prior-art incubators have the drawback that the access to the patient by the care personnel and by the parents is greatly limited because of the closed incubator hood.

Even though so-called open care devices, which have a radiant heater as well as a mattress heater, which is optionally present in order to maintain the small patient under thermally neutral conditions, are also known as an alternative to the incubators closed by means of a hood, the ambient humidity is nonphysiological for the immature prematurely born patient. This leads to very high transepidermal losses of water and to dehydration of the patient, which cannot be compensated by the only limited availability of infusions. The high radiant output necessary leads to high skin temperatures and to the steady risk for overheating or even burn. Nevertheless, open care devices are preferably used despite the said drawbacks because of the good access to the patient when a prematurely born patient is not yet stable physiologically and requires intensive care measures. Due to the irreconcilable conflict between the desired microclimate in the closed incubator with the greatly limited access to the patient, on the one hand, and, on the other hand, the desired unhindered access to the patient in open care devices, which is, however, associated with heat supply from one side, where one cannot speak of a comfortable microclimate, attempts have already been made at resolving the conflict with a so-called hybrid device.

In U.S. Pat. No. 6,213,935 B1, the top side of the hood of an incubator is raised by means of an elevator when needed, so that the open care can be performed with the radiant heater integrated in the top side of the hood. When the top side of the hood is lowered, the radiant heater is switched off, so that a usual incubator with convection function is made available when the top side of the hood is lowered.

U.S. Pat. No. 5,817,002 shows an open care unit with a bed, which has air outlet channels on three sides and is to generate a microclimate above the patient's bed. A hood with a radiant heater likewise offers the possibility of providing as an alternative a closed incubator.

These prior-art concepts shall embody two types of device in one, where there is a switch-over between the different operating states, so that the heat supply by warm air convection prevails in the closed incubator, and the heat supply by heat radiation by means of a radiant heater prevails in the open care device. One drawback of these prior-art concepts arises from the switch-over between the different paths of heat transfer, because there is no heat equilibrium for the patient during the switch-over time and beyond because the heat sources require a finite time to heat up. This means that the patient cools down during each switch-over and it may take more than an hour each time for the patient to reach his original body temperature again.

SUMMARY OF THE INVENTION

Accordingly, the object of the present invention is to provide an incubator that supplies both a good microclimate and guarantees good access to the patient at the same time and continuously.

According to the invention, a hoodless incubator is provided including a bed and an air jet unit arranged above the bed and directed toward the bed. The air jet unit discharges a jacketed impinging jet, comprising an inner, air-conditioned core jet and a non-air-conditioned jacket jet jacketing the core jet. The bed is surrounded by a channel-like edge area, which is in flow connection via a first feed channel with a first fan arranged therein and with a heating and humidifying means likewise arranged therein with an air jet unit in order to form the air-conditioned core jet.

An essential advantage of the present invention arises from the fact that no switch-over between different operating states is necessary and cooling of the patient is thus prevented from occurring, but, on the other hand, both good conditioning in terms of the air temperature and humidity is available for the patient and the patient is readily accessible.

The jacket jet may advantageously consist essentially of ambient air, which is fed to the air jet unit via a second feed channel with a second fan.

The velocities of the core jet and the jacket jet during the discharge from the air jet unit may advantageously be between 0.2 m and 1 m per sec. The ratio of the velocity of the core jet to the velocity of the jacket jet may advantageously be approx. 3:1.

The air volume flow discharged from the air jet unit may advantageously be 300 to 900 L per minute for the core jet and 600 L to 1,800 L per minute for the jacket jet.

The air jet unit may advantageously be arranged pivotably above one of the front surfaces of the bed, so that the impinging jet discharged from the air jet unit, which is composed of the core and jacket jets, forms an angle of less than 90° and preferably 20° to 70° with the bed.

An additional radiant heater may advantageously be present for the bed.

An air outlet to the environment, which is preferably located between the first fan and the heating and humidifying means may advantageously be provided in the first feed channel.

The heating and humidifying means may advantageously be controlled as a function of the temperature and the humidity of the ambient air such that a preset temperature and a preset humidity are obtained in the area above the bed.

The core jet may advantageously have a relative humidity between 35% and 85% and a temperature between 28° C. and 39° C. The relative humidity and the temperature of the jacket jet discharged from the air jet unit may advantageously correspond to those of the ambient air.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
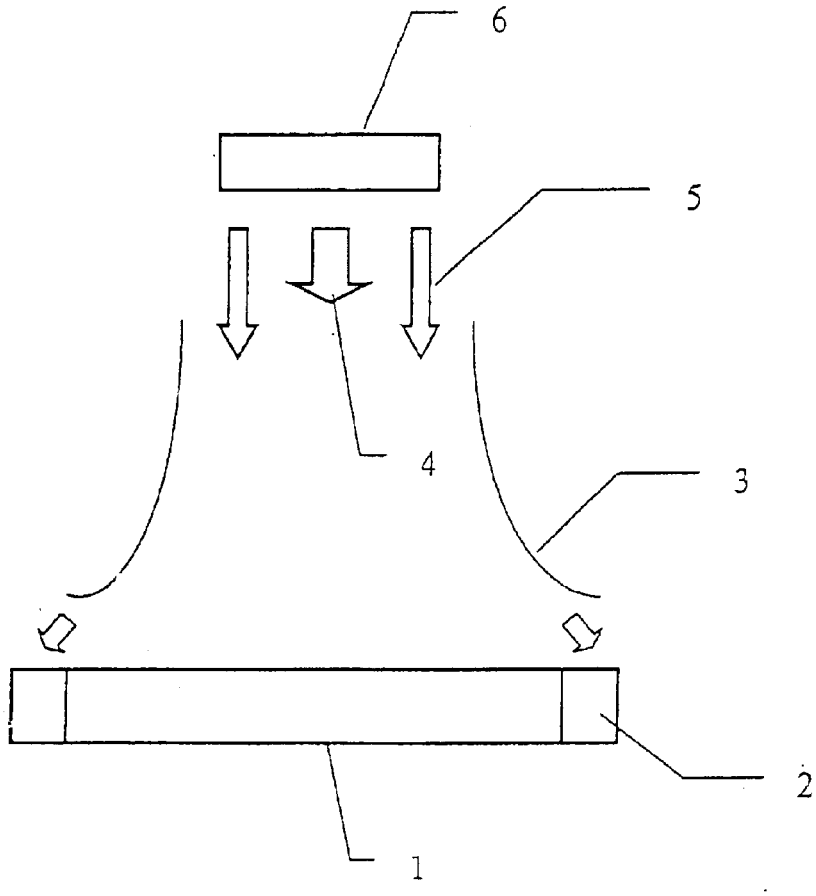
FIG. 1 is a schematic view showing a vertical section along the bed for an arrangement of the present invention.

Referring to the drawings in particular, identical components are designated by identical reference numbers.

The arrangement of a hoodless incubator according to the present invention is shown schematically in FIG. 1 in a vertical section along the bed 1 for the patient.

An air jet unit 6, from which specifically processed air is discharged as an air jet in the form of a plurality of parallel air flows with different temperatures and humidity levels, is arranged above the bed 1. This air jet is a jacketed impinging jet, which comprises, e.g., an inner, air-conditioned core jet 4, which supplies the warm and humid air for the air conditioning of the bed 1 and consequently for the microclimate of the patient, and has a jacket jet 5 of cooler and drier air on the outside, which is drawn off laterally at all four side channels 2 limiting the bed 1 as a cold edge jet 3. The cooler edge jet 3 counteracts the thermal buoyancy and holds the warm and humid air of the core jet 4 together. As a result, a desired stable microclimate develops on the bed 1. The velocities, temperatures and humidity levels of the composite air jet are coordinated with one another such that the entire flow field above the bed 1 is stable: The air velocities of the core jet 4 and of the jacket jet 5 are in the range of 0.2 and 1 m per sec during the discharge from the air jet unit 6, and the ratio of the velocity of the core jet 4 to the velocity of the jacket jet 5 is preferably approximately 3:1.

The effective discharge areas during the discharge from the air jet unit 6 are, e.g., 400 square cm for the core jet 4 and 1,000 square cm for the jacket jet 5.

Figure 2:
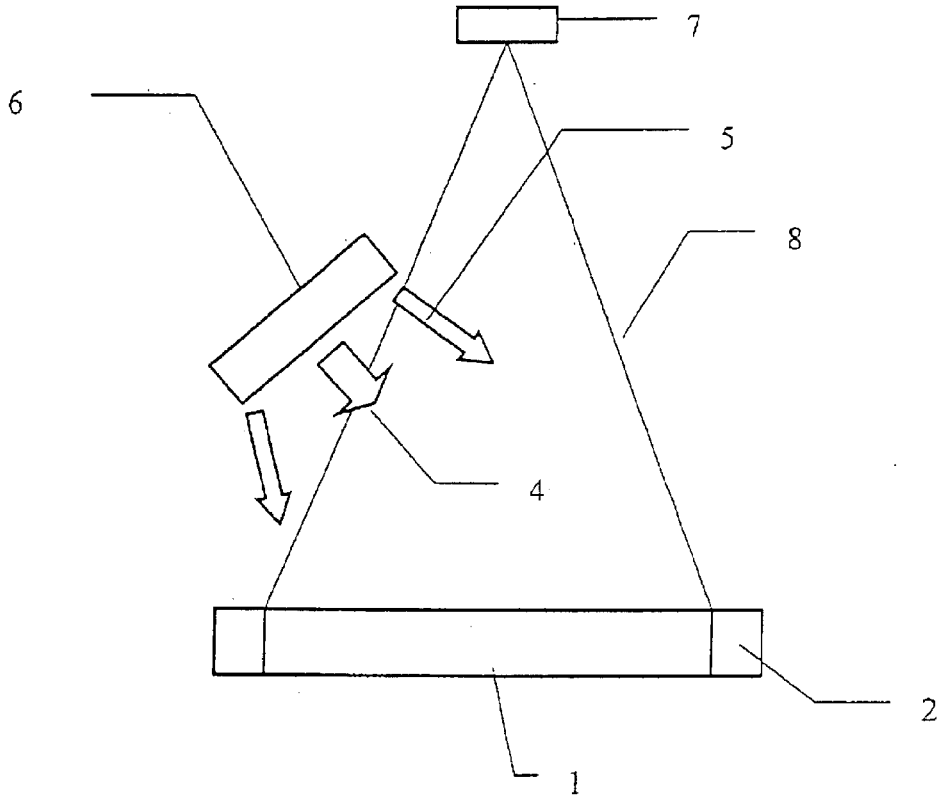
FIG. 2 is a schematic view showing a vertical section along the bed for a second arrangement of the present invention.

The temperature and the humidity of the core jet 4 correspond to the desired microclimate, namely, to an air temperature selectable between 28° C. and 39° C. and a relative humidity between 35% and 85%. The temperature and humidity of the jacket jet 5 are, in general, at the values of the ambient air, but the temperature may also be below the ambient air temperature. As a result, the flow velocities directly on the bed 1 are approx. 0.06 to 0.18 m per sec. The quasi stationary microclimate is disturbed only slightly even in the case of minor disturbances in the jacketed air jet, e.g., during care procedures at the patient. This also applies to draft phenomena in the room, when, e.g., a person is walking by the incubator or the door or a window is briefly opened. As a variant of the arrangement according to FIG. 1, the air jet unit 6 may also be inclined pivotably obliquely above the bed 1 in the direction of a front surface, so that it is arranged according to FIG. 2 above the other, opposite front surface. This variant has the advantage that the air jet unit 6 does not interfere with the X-raying of the patient, i.e., it is located outside the schematically outlined ray path 8 of an X-ray apparatus. This variant also allows the use of a radiant heater 7, which can supply the patient with additional heat output when the pure convective heat is not sufficient to keep the patient in a thermal equilibrium. The additional radiant heater 7 may be necessary, e.g., in the case of cool and air-conditioned rooms and especially in the case of small premature babies during the first days of life when their transepidermal water losses are still very high because of the yet undeveloped, immature stratum corneum.

Figure 3:
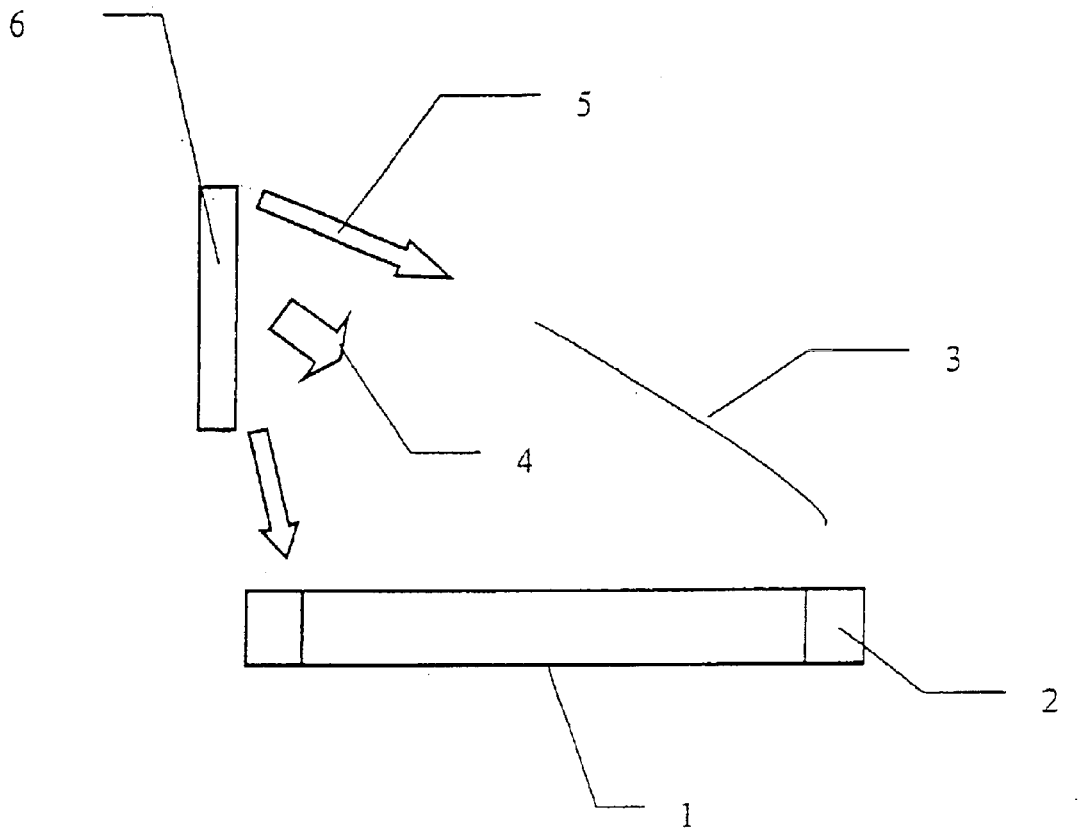
FIG. 3 is a schematic view showing a vertical section along the bed for a modified arrangement according to FIG. 2.

The air jet unit 6 may also be pivoted by up to 90° from the bed 1 according to FIG. 3, and it is located at one of the front sides of the incubator or the bed 1 in this case. The entire bed 1 is accessible in this case from three sides without hindrance for care procedures, for X-raying, for the additional radiant heater 7 or for a phototherapy means.

Figure 4:
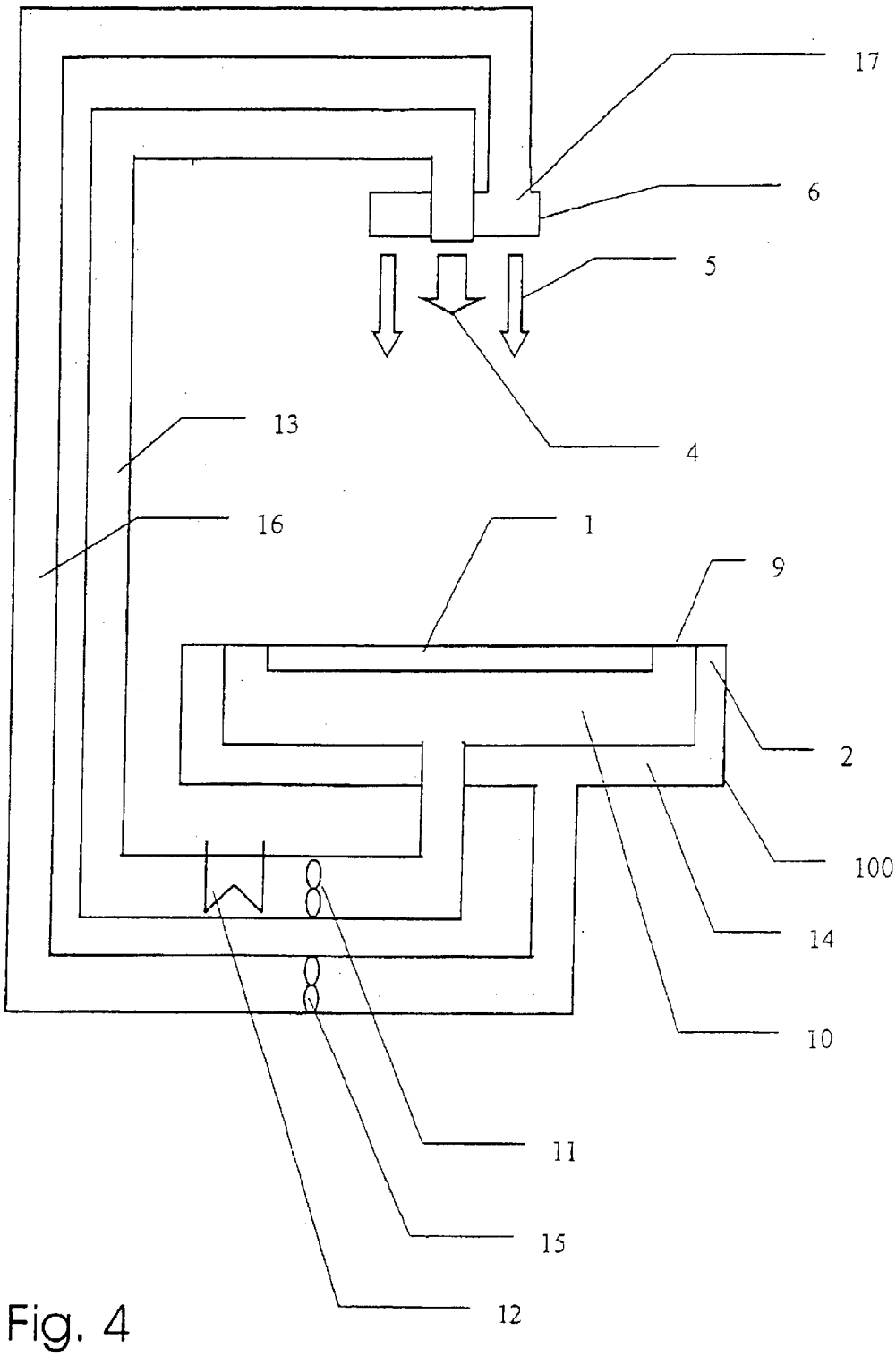
FIG. 4 is a vertical sectional view through a first embodiment of a hoodless incubator.

FIG. 4 shows the air circulation of the hoodless incubator: The bed 1 proper for accommodating the patient is located in the bed housing 100.

Essentially only the air-conditioned air, which is located above the bed 1, is drawn off in the channel-like edge area 9 directly around the bed 1. The air-conditioned air is drawn in by a first fan 11 via a first intermediate housing 10, and heated and humidified by means of a heating and humidifying means 12. The air thus air-conditioned is then fed centrally to the air jet unit 6 via a first feed channel 13 in order to form the core jet 4 there. The feed channel 13 may be heated and/or insulated in order to prevent the air-conditioned air from condensing. The heating along part or along the entire feed channel 13 may optionally replace the heating of the heating and humidifying means 12. The cooler jacket jet 5 passes over into the edge jet 3 shown in FIGS. 1 and 3 and is drawn off extensively in the side channels 2 surrounding the bed 1 by a second fan 15 and united in a second intermediate housing 14. This relatively cool and relatively dry air is fed to the air jet unit 6 via a second feed channel 16. It is split there uniformly circumferentially such that it forms the jacket jet 5 around the core jet 4 and is returned to the bed 1 in a directed manner. Both the core jet 4 and the jacket jet 5 may be further subdivided into a plurality of parallel air flows with different discharge velocities in order to improve the action of the jacketing and to make it more stable. Both the air of the core jet 4 and that of the jacket jet 5 are extensively circulated in the example and are enriched with ambient air only partially.

Figure 5:
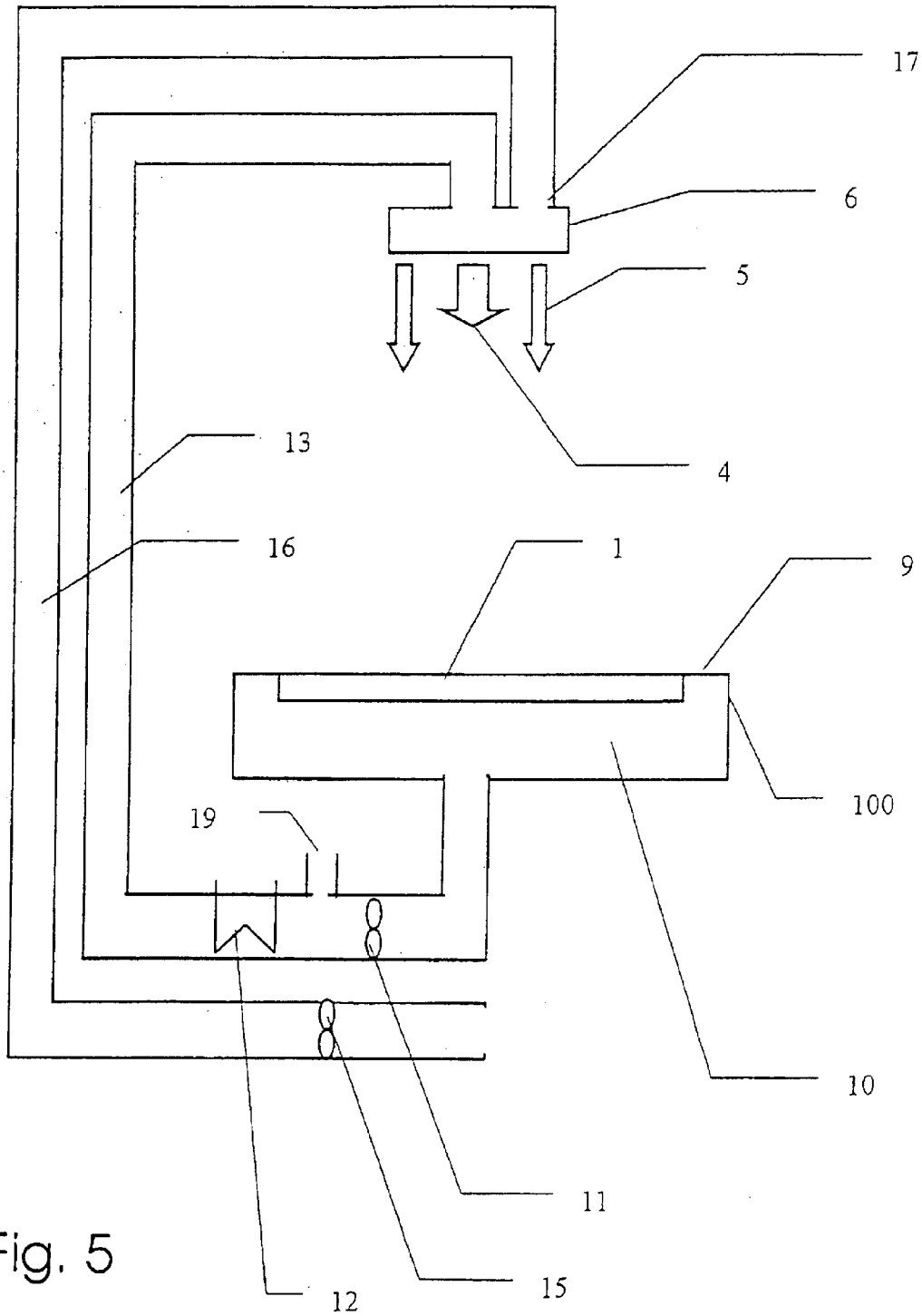
FIG. 5 is a vertical sectional view through a second embodiment of a hoodless incubator.

FIG. 5 shows the air circulation of a second hoodless incubator: The bed 1 proper for accommodating the patient is located in the bed housing 100.

Essentially only the air-conditioned air of the core jet 4 and only part of the jacket jet 5 are drawn off together in the channel-like edge area 9 of the bed 1. The air is drawn in by the first fan 11 via the intermediate housing 10, and heated and humidified by means of the heating and humidifying means 12. A partial flow of the air drawn in is removed downstream as an excess into the environment after the first fan 11 through an air outlet 19. The second fan 15 draws in fresh air from the environment and leads it into the air jet unit 6, where it is directed as a jacket jet 5 toward the bed 1 in order to stabilize the core jet 4. Other variants of the present invention are possible.

Figure 6:
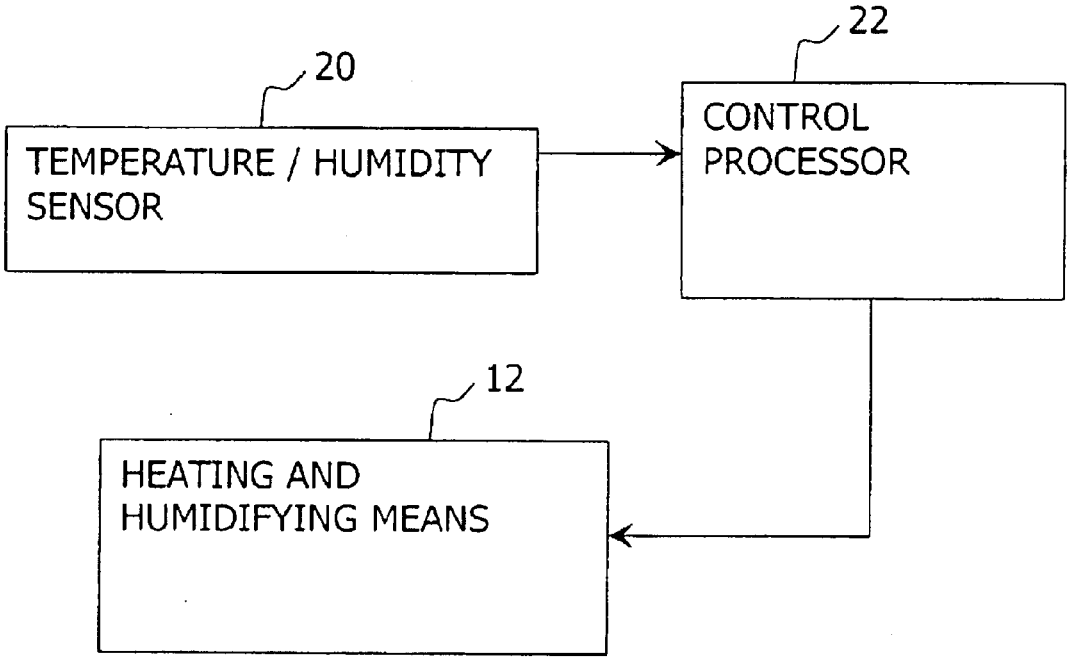
FIG. 6 is a flow diagram of the control process of the present invention.

The heating and humidifying means 12 may be controlled as a function of the temperature and the humidity of the ambient air as shown in FIG. 6. The heating and humidifying means 12 is connected to a control processor 22 which is connected to a temperature/humidity sensor or temperature/humidity sensor arrangement 20. The temperature sensor arrangement 20 is positioned in area above the bed 1. Based on the sensed temperature and humidity at sensor arrangement 20, the control processor 22 controls the heating and humidifying means 12 such that a preset temperature and a preset humidity are obtained in the area above the bed 1.

The bed 1 may be provided with low side walls with a height of about 10 cm to 25 cm within the framework of the present invention in order to prevent the patient from falling out of the bed 1. When raised, the side walls can additionally stabilize the flow of the microclimate. The bed 1 may optionally also be provided with a mattress heater to compensate increased heat losses of the patient.

In general, prior-art bacteria or sterilizing filters are located in the feed channel 13 for the circulated air-conditioned air in order to rule out the infestation of the air-conditioned air with microorganisms with certainty.

While specific embodiments of the invention have been shown and described in detail to illustrate the application of the principles of the invention, it will be understood that the invention may be embodied otherwise without departing from such principles.

What is claimed is:

1. A hoodless incubator, comprising:

a bed having a bed surface with a peripheral edge;

an air jet unit arranged above the bed and directed toward the bed, said air jet unit discharging a jacketed impinging jet, comprising an inner, air-conditioned core jet and a non-air-conditioned jacket jet jacketing the core jet;

a fan;

a heating and humidifying device;

a channel-like edge area defining an air intake extending annularly about said peripheral edge of said bed and surrounding said bed at said bed surface; and a feed channel, said fan being arranged in said feed channel and said heating and humidifying device being arranged in said feed channel, said channel-like edge area being in flow connection via said feed channel with said air jet unit in order to form said air-conditioned core jet, said feed channel said bed and said air jet unit being disposed relative to each other to provide an access space continuing uninterrupted from said air jet unit to a surface of said bed on at least one side of said bed.

2. A hoodless incubator in accordance with claim 1, further comprising a second feed channel with a second fan, wherein said non-air-conditioned jacket jet consists essentially of ambient air, which is fed to the air jet unit via said second feed channel with said second fan.

3. A hoodless incubator in accordance with claim 1, wherein the velocities of said core jet and said jacket jet during the discharge from said air jet unit are between 0.2 m and 1 m per sec and the ratio of the velocity of the core jet to the velocity of the jacket jet is approx. 3:1.

4. A hoodless incubator in accordance with claim 1, wherein the air volume flow discharged from the air jet unit is 300 to 900 L per minute for the core jet and 600 L to 1,800 L per minute for the jacket jet.

5. A hoodless incubator in accordance with claim 1, wherein said air jet unit is arranged pivotably above one of the front surfaces of the bed, so that the impinging jet discharged from said air jet unit, which is composed of said core jet and said jacket jet forms an angle of less than 90° with the bed.

6. A hoodless incubator in accordance with claim 1, wherein said air jet unit is arranged pivotably above one of the front surfaces of the bed, so that the impinging jet discharged from said air jet unit, which is composed of said core jet and said jacket jet forms an angle of 20° to 70° with the bed.

7. A hoodless incubator in accordance with claim 1, further comprising a radiant heater disposed for directing heat toward said bed.

8. A hoodless incubator in accordance with claim 1, wherein said feed channel has an air outlet to the environment other than outlets discharging said inner, air-conditioned core jet and said non-air-conditioned jacket jet.

9. A hoodless incubator in accordance with claim 8, wherein said air outlet to the environment is located between the fan and the heating and humidifying device.

10. A hoodless incubator in accordance with claim 1, wherein the heating and humidifying device is controlled as a function of the temperature and the humidity of the ambient air such that a preset temperature and a preset humidity are obtained in the area above the bed.

11. A hoodless incubator in accordance with claim 1, wherein the core jet has a relative humidity between 35% and 85% and a temperature between 28° C. and 39° C., and the relative humidity and the temperature of the jacket jet discharged from said air jet unit correspond to those of the ambient air.

12. An incubator system, comprising:

a patient surface supported raised above a floor and having a patient surface edge without plural side walls;

an air jet unit arranged above the patient surface and directed toward the patient surface, said air jet unit discharging a jacketed impinging jet, comprising an inner, air-conditioned core jet and a non-air-conditioned jacket jet jacketing the core jet, said patient surface and said air jet unit being disposed relative to each other to provide an access space continuing uninterrupted from said air jet unit to said patient surface on at least one side of said patient surface;

a fan;

a heating and humidifying device;

an annular channel surrounding said patient surface at an edge of said patient surface;

a feed channel, said fan being arranged in said feed channel and said heating and humidifying device being arranged in said feed channel, said annular channel being in flow connection via said feed channel with said air jet unit in order to form said air-conditioned core jet wherein said feed channel connects to said air jet unit without interrupting said access space; and a second feed channel with a second fan, wherein said non-air-conditioned jacket jet consists essentially of ambient air, which is fed to the air jet unit via said second feed channel with said second fan.

13. An incubator system in accordance with claim 12, wherein the velocities of said core jet and said jacket jet during the discharge from said air jet unit are between 0.2 m and 1 m per sec and the ratio of the velocity of the core jet to the velocity of the jacket jet is approx. 3:1.

14. An incubator system in accordance with claim 12, wherein the air volume flow discharged from the air jet unit is 300 to 900 L per minute for the core jet and 600 L to 1,800 L per minute for the jacket jet.

15. An incubator system in accordance with claim 12, wherein said air jet unit is arranged pivotably above one of the front surfaces of the patient surface, so that the impinging jet discharged from said air jet unit, which is composed of said core jet and said jacket jet is directable at said patient surface at an angle of from 90° to less than 90° with respect to said patient surface whereby the access space continuing uninterrupted from said air jet unit to said patient surface on at least one side of said patient surface may be varied.

16. An incubator system in accordance with claim 12, further comprising a radiant heater disposed for directing heat toward said patient surface.

17. An incubator system in accordance with claim 12, wherein said feed channel has an air outlet to the environment located between the first fan and the heating and humidifying device.

18. An incubator system in accordance with claim 12, wherein the heating and humidifying device is controlled as a function of the temperature and the humidity of the ambient air such that a preset temperature and a preset humidity are obtained in the area above the patient surface based on a core jet having a relative humidity between 35% and 85% and a temperature between 28° C. and 39° C., and said jacket jet discharged from said air jet unit having a relative humidity and a temperature substantially corresponding to those of the ambient air.

19. A hoodless incubator, comprising:

a bed having a surface;

an air jet unit arranged above the bed and directed toward the bed, said air jet unit discharging a jacketed impinging jet, comprising an inner, air-conditioned core jet and a non-air-conditioned jacket jet jacketing the core jet;

a fan;

a heating and humidifying device;

a channel-like edge area surrounding said bed;

a feed channel, said fan being operatively connected to said feed channel to move air therein and said heating and humidifying device being operatively connected to said feed channel to heat and humidify air therein, said channel-like edge area being in flow connection via said feed channel with said air jet unit in order to form said air-conditioned core jet wherein said air jet unit is arranged pivotably above the surface of said bed, so that the impinging jet discharged from said air jet unit, which is composed of said core jet and said jacket jet forms an angle of from 90° to less than 90° with respect to the surface of said bed.

20. A hoodless incubator, comprising:

a bed having a surface;

an air jet unit arranged above the bed surface and directed toward the bed surface, said air jet unit discharging a jacketed impinging jet, comprising an inner, air-conditioned core jet and a non-air-conditioned jacket jet jacketing the core jet;

a fan;

a heating and humidifying device;

a channel-like edge area surrounding said bed at a level of said bed surface;

a first feed channel, said fan being operatively connected to said first feed channel to move air therein and said heating and humidifying device being operatively connected to said first feed channel for heating and humidifying air therein, said channel-like edge area being in flow connection via said first feed channel with said air jet unit in order to form said air-conditioned core jet;

a second feed channel;

a second fan operatively connected to said second feed channel to move air therein, said second feed channel feeding air to said jet unit via said second feed channel with said second fan to form said non-air-conditioned jacket jet.

21. A hoodless incubator in accordance with claim 20, wherein said second feed is connected to in intake receiving air from the environment such that said non-air-conditioned jacket jet consists essentially of ambient air.

22. A hoodless incubator in accordance with claim 20, further comprising an additional side channel at least partially surrounding said bed and spaced radially outwardly of said channel-like edge area, said additional side channel being in flow connection via said second feed channel with said air jet unit in order to form said said non-air-conditioned jacket jet.

* * * * *